US006872662B1

(12) United States Patent
Hocheng et al.

(10) Patent No.: US 6,872,662 B1
(45) Date of Patent: Mar. 29, 2005

(54) METHOD FOR DETECTING THE ENDPOINT OF A CHEMICAL MECHANICAL POLISHING (CMP) PROCESS

(76) Inventors: Hong Hocheng, No. 101, Sec. 2, Guangfu Rd., Hsinchu City 300 (TW); Yun-Liang Huang, No.1, Lising 2nd Rd., Hsinchu City 300 (TW)

( * ) Notice: Subject to any disclaimer, the term of this patent is extended or adjusted under 35 U.S.C. 154(b) by 0 days.

(21) Appl. No.: 10/695,106

(22) Filed: Oct. 27, 2003

(51) Int. Cl.[7] ..... H01L 21/302; H01L 21/461
(52) U.S. Cl. ..... 438/692; 438/907; 438/959
(58) Field of Search ..... 438/8, 691, 734, 438/747, 753, 759, 907, 909, 959

(56) References Cited

U.S. PATENT DOCUMENTS 5,196,353 A * 3/1993 Sandhu et al. ..... 438/5
5,597,442 A 1/1997 Chen et al. ..... 156/626.1
5,643,050 A 7/1997 Chen ..... 451/10
5,647,952 A * 7/1997 Chen ..... 438/8
5,722,875 A 3/1998 Iwashita et al. ..... 451/8
6,007,408 A 12/1999 Sandhu ..... 451/41
6,077,783 A 6/2000 Allman et al. ..... 438/691
6,150,271 A 11/2000 Easter et al. ..... 438/692

* cited by examiner

*Primary Examiner*—Phuc T. Dang

(57) ABSTRACT

A method for detecting the endpoint of a chemical mechanical polishing (CMP) process uses the slope variation of temperature difference of polishing pad. The method combines temperature measurement at polishing pad and atmosphere, and numerical analysis to figure out the curve of temperature difference variation versus polishing time. The endpoint of CMP is determined by the change of the slope of the curve. The method allows endpoint to be detected in-situ at the polishing apparatus, without stopping polishing process.

16 Claims, 6 Drawing Sheets

(PARIOR ART)

METHOD FOR DETECTING THE ENDPOINT OF A CHEMICAL MECHANICAL POLISHING (CMP) PROCESS

FIELD OF THE INVENTION

The present invention relates to a semiconductor manufacturing process, and more particularly to a method to detect the endpoint of a chemical mechanical polishing (CMP) process based on the temperature slope of the polishing pad.

BACKGROUND OF THE INVENTION

Advances in semiconductor manufacturing technology have enabled progress to be seen in the scale finely. In the semiconductor manufacturing of a deep submicron process, the depth of focus shrinks constantly to reach the need for increasing speed and the resolution for lithography raises constantly as well. In order to accomplish the above purposes, global planarization of the wafer surface is highly required, and therefore a CMP process to achieve the goal is also needed.

FIG. 1 shows a conventional CMP apparatus. With reference to FIG. 1, the CMP apparatus constitutes of at least one carrier 110, for holding a semiconductor wafer 120. The carrier 110 holds the wafer 120 against the surface of the polishing pad 130 attached to the rotary polishing platen 131. And the wafer 120 and the polishing pad rotate mutually. During planarization, the wafer 120 oscillates with the polishing pad, and polishing slurry 140 comprised of abrasive fluid, such as silica or alumina abrasive particles suspended in either a basic or an acidic solution, is dispended on the polishing pad and goes into the space between the wafer 120 and the polishing pad 130, through a conduit 141. Then mechanical and chemical polishing effects take place on the wafer 120 between the carrier 110 and the polishing pad 130. The combination of mechanical and chemical polishing effects removes the excessive layers of metal material from the surface of the wafer 120, and accomplishes global planarization.

In the CMP process, the wafer 120 is pressed on the polishing pad 130 because of the downward pressure. Therefore, it is difficult to consistently stop the CMP process at a desired endpoint and to produce a uniform, planar surface on the wafer by measuring the wafer surface. The general statistics shows that two more hours is demanded to measure the wafer surface produced by the conventional CMP process to determine if the wafer surface is planarized well or not. For this reason, the productivity of the CMP process decreases 50%, and the cost of the wafer produced consumes more. The following then says the prior art about the endpoint detection method for the conventional CMP process.

U.S. Pat. No. 5,196,353 entitled "Method for controlling a semiconductor (CMP) process by measuring a surface temperature and developing a thermal image of the wafer" issued on Mar. 23, 1993 to Gurtej S. Sandhu et al. describes the use of an infrared radiation detection in the polishing pad to take the thermal image of the surface of a wafer to adjust the parameters of the process. In application, the surface of a wafer posts to the polishing pad tightly, and therefore it is difficult to take the thermal image of the wafer surface.

U.S. Pat. No. 5,597,442 entitled "Chemical/mechanical planarization (CMP) endpoint method using measurement of polishing pad temperature" issued on Jan. 28, 1997 to Hsi-Chich Chen et al. describes the endpoint for planarization process is determined by monitoring the temperature of the polishing pad with an infrared temperature measuring device. The method determines the endpoint when the temperature decreases by 2° C. In application, it needs to control the temperature of the slurry, and the detected temperature jounces with the slurry. Therefore, it is difficult to determine the endpoint by measuring the polishing pad temperature decreases by 2° C.

U.S. Pat. No. 5,643,050 entitled "Chemical/mechanical polish (CMP) thickness monitor" issued on Jul. 1, 1997 to Lai-Juh Chen et al. describes the method comprises monitoring the temperature of the polishing pad or the polished substrate versus polishing time, integrating the polishing temperature change versus polish time curve with polish time, and applying computer stored integration coefficients to the integrated area to derive the removed thickness. In application, it needs complicated operation processes, and the thickness of the thin film of the wafer surface is not uniform. Therefore, it is difficult to determine the endpoint accurately.

U.S. Pat. No. 5,647,952 entitled "Chemical/mechanical polish (CMP) endpoint method" issued on Jul. 15, 1997 to Lai-Juh Chen et al. describes the method for measuring the temperature of the specific area of the polishing pad, and determining the endpoint by detecting a change in said temperature. In application, it needs to control the temperature of the slurry, and the detected temperature jounces with the slurry. Therefore, it is difficult to determine the endpoint by measuring the polishing pad temperature.

U.S. Pat. No. 5,722,875 entitled "Method and apparatus for polishing" issued on Mar. 3, 1997 to Mitsuaki Iwashita et al. describes the use of an infrared temperature sensor to determine the end point of CMP. In application, the detected temperature jounces with the slurry. Therefore, it is difficult to determine the endpoint. Accurately by measuring a single point temperature of the polishing pad.

U.S. Pat. No. 6,007,408 entitled "Method and apparatus for endpointing mechanical and chemical-mechanical polishing of substrates" issued on Dec. 28, 1999 to Gurtej S. Sandhu et al. describes the method for measuring the temperature of the backside of the substrate, the polishing pad, planarizing liquid, and the CMP byproducts simultaneously. In application, the change temperature of the byproduct is not evident, and the temperature of the byproduct decreases before being detected. Therefore, it is difficult to determine the endpoint accurately.

U.S. Pat. No. 6,077,783 entitled "Method and apparatus for detecting a polishing endpoint based upon heat conducted through a semiconductor wafer" issued on Jan. 20, 2000 to Derryl D. J. Allman et al. describes the method for determining the endpoint by heating a semiconductor wafer so as to cause the surface of the semiconductor wafer to have a specific temperature, and the temperature of said semiconductor wafer changes as the surface of said semiconductor wafer is being removed. In application, the range of the change temperature of said semiconductor wafer would decrease after heat pass the carrier. Therefore, it is difficult to determine the endpoint accurately.

U.S. Pat. No. 6,150,271 entitled "Differential temperature control in chemical mechanical polishing processes" issued on Nov. 21, 2000 to William Graham Easter et al. describes the method for determining the endpoint of the CMP process by installing heating and cooling coils to control the rate of the material removed from the surface of the wafer. In application, the temperature of the carrier easily changes with the influence of environment. Therefore, it is difficult to control the temperature and determine the endpoint accurately.

Thus, there is a strong demand in a method for determining an endpoint of the CMP process accurately and efficiently.

SUMMARY OF THE INVENTION

In accordance with the present invention, a method for determining an endpoint of a CMP process by detecting the variation of temperature slope of a polishing pad is provided.

A feature of the invention is to measure the temperature distribution by a non-contact temperature measuring device, and to calculate the data detected by the temperature measuring device with simple numerical methods to make a curve which shows the trend of the temperature slope of the polishing pad versus polishing time. According to the curve, the method of the invention can easily find out the when the temperature changes obviously, and can thus determine the endpoint of CMP in situ without affecting the process to avoid that the prior art cannot determine the endpoint of the CMP process in situ accurately and efficiency. Furthermore, the method of the invention measures an environmental temperature as a reference to avoid the variation of the measured temperature due to the slurry or environment.

In an illustrative embodiment, an apparatus for carrying out the method of the invention includes: at least a carrier, which fixes the wafer to the surface of the polishing pad on the rotary polishing platen. The wafer and the polishing pad rotate mutually. During planarization, the polishing slurry comprising abrasive particles is dispended on the polishing pad through a conduit. It causes mechanical and chemical polishing effects to the wafer between the carrier and the polishing pad. The combination of mechanical and chemical polishing effects makes the excessive metal material removed from the surface of the wafer, and planarizes the wafer. Moreover, apparatus for carrying out the method of the invention further include at least a non-contact temperature measuring device, which measures at least one environmental temperature.

As described above, said non-contact temperature measuring device may be a single point temperature measuring device or a thermal image camera, and the single point temperature measuring device may be an infrared detection device.

As described above, the non-contact temperature measuring device measures the environmental temperature on the central portion of the polishing pad, the edge portion of the polishing pad, any portion of the CMP apparatus in addition to the rotary polishing platen, or any portion of the stable temperature in the environment.

Then, the non-contact temperature measuring device measures the temperature of at least one point in the friction surface, describes just after the wafer and the polishing pad rotate mutually. Thereafter, do a data processing for said measured temperature by at least one operation device.

The difference between the measured polishing pad and the environmental temperature is calculated to obtain a raised temperature difference of the polishing pad for polishing, in order to get the variation of the polishing pad temperature accurately and to eliminate the interference from the polishing slurry to said non-contact measuring device.

Furthermore, make the curve, describes the temperature difference versus time with simple numerical methods. Then, make a curve, describes the variety of temperature slope of the polishing pad versus polishing time, to determine the endpoint of CMP.

As described above, the operation device is built-in the measuring device or is linked to a computer.

As described above, the numerical methods may be the least square method or other linear regression methods.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
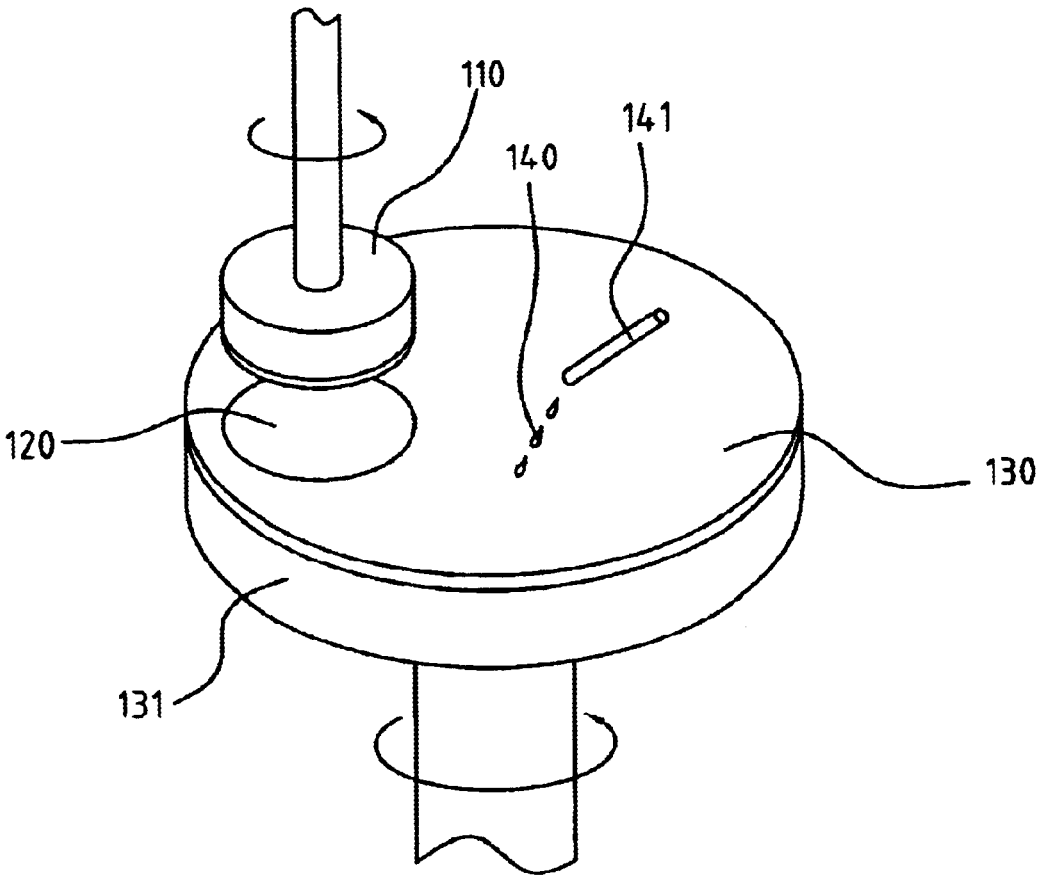
FIG. 1 shows a conventional CMP apparatus.
Figure 2:
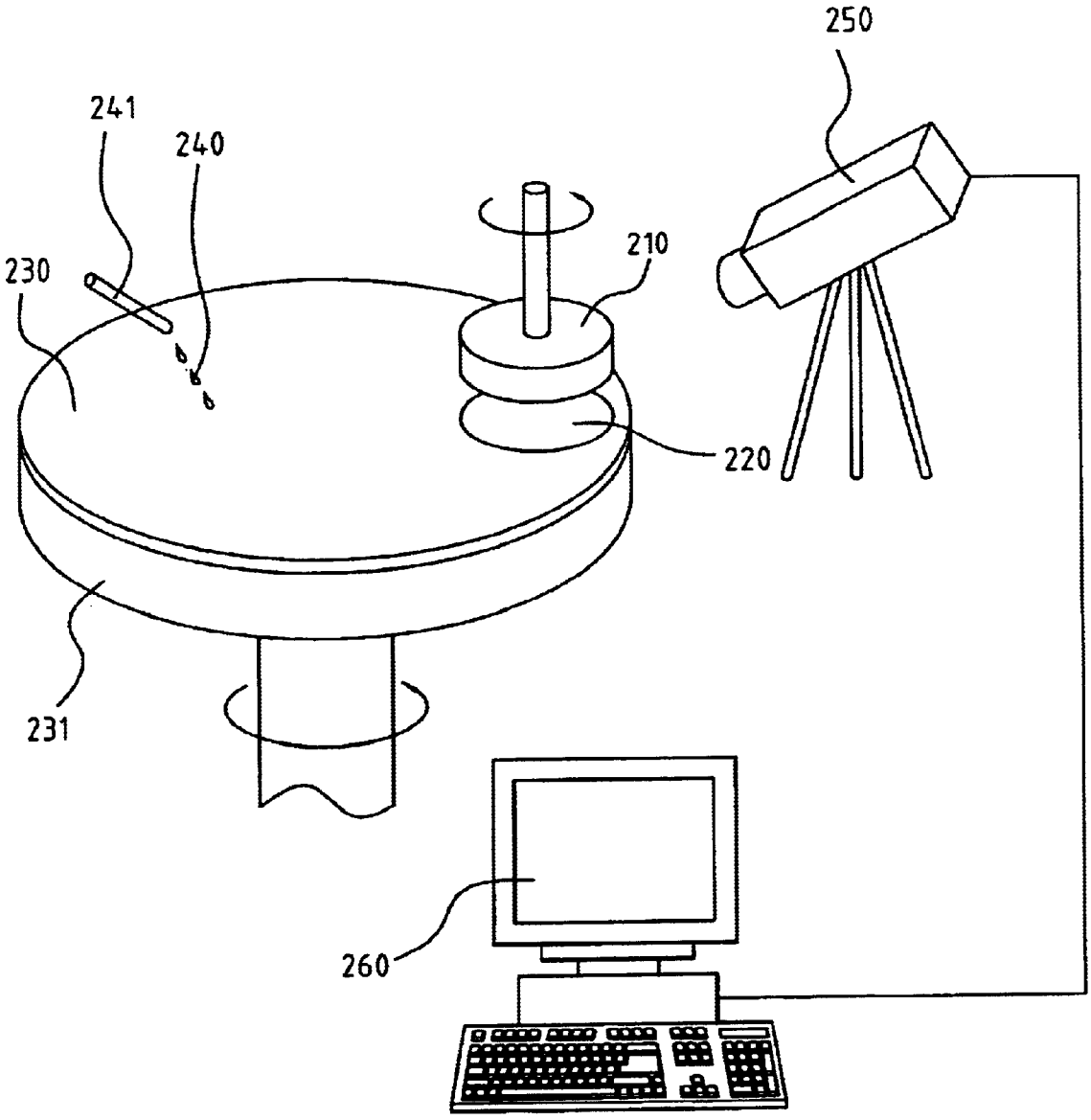
FIG. 2 shows the apparatus according to the method of the invention.

FIG. 2 shows the apparatus according to the present invention. With reference to FIG. 2, the CMP apparatus of the invention includes a carrier 210, for holding a semiconductor wafer 220. The carrier 210 fixes the wafer 220 to the surface of the polishing pad 230 attached on the rotary polishing platen 231. During planarization, the wafer 220 moves with the polishing, and polishing slurry 240 comprising an abrasive fluid, such as silica or alumina abrasive particles suspended in either a basic or an acidic solution, is dispended on the pad and flows into the gap between the wafer 220 and the polishing pad 230, through a conduit 241 above the polishing pad 230. Mechanical and chemical polishing effects take place on the wafer 220. The combination of mechanical and chemical polishing effects makes the removal of the excessive metal material from the surface of the wafer 220, and thus planarizes the wafer 220. Furthermore, a non-contact thermal image camera 250 linked to a PC 260 is setup next to the CMP apparatus.

Figure 3:
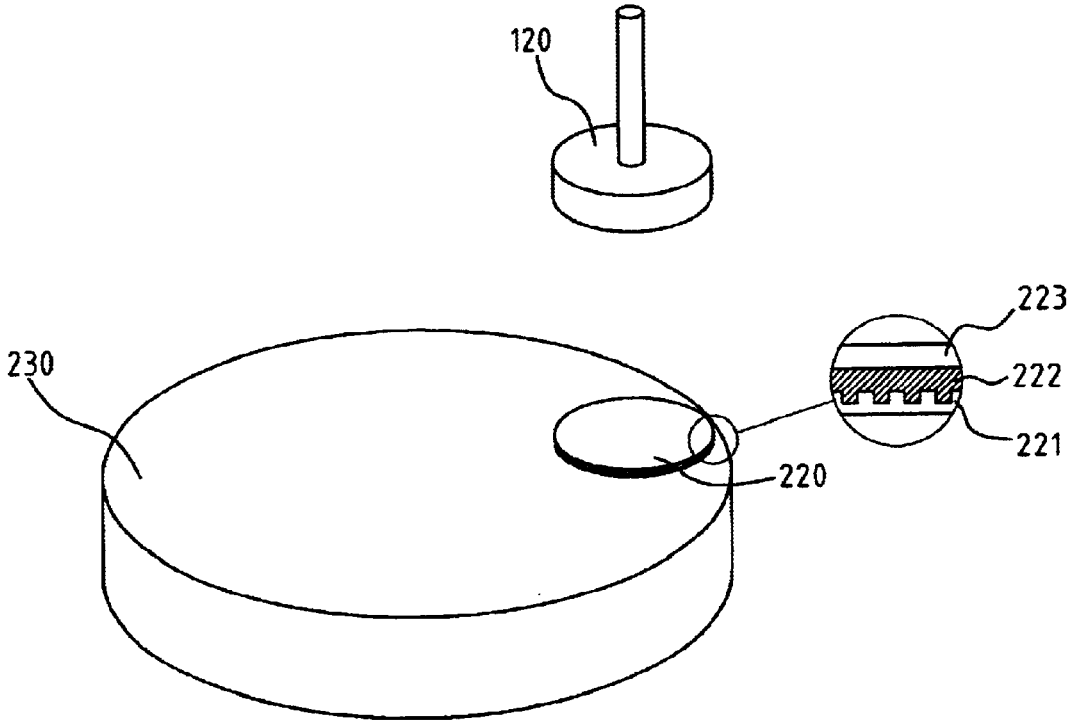
FIG. 3 shows spatial relationship between the wafer, the carrier, and the polishing pad of the invention.

FIG. 3 shows spatial relationship between the wafer, the carrier, and the polishing pad of the invention. With reference to FIG. 3, in the CMP process, the temperature of the polishing pad 230 rises as polishing. And the rise in temperature is dependent on the relative velocity and the coefficient of friction between the polishing pad 230 and the wafer 220.

At the beginning of the CMP process, the polishing pad 230 polishes the first film of the wafer 221 only, thus the rise in temperature is dependent on the relative velocity between the polishing pad 230 and the wafer 220 and the coefficient of friction between the polishing pad 230 and the first film of the wafer 221, so that the rise in temperature of the polishing pad 230 varies linearly with time.

As described above, the first film of the wafer 221 may be made of metal material.

When one part of the first film of the wafer 221 is removed, the polishing pad 230 starts to polish the second film of the wafer 222. Thereat, the polishing pad 230 polishes the first film of the wafer 221 and the second film of the wafer 222 at the same time. The rise in temperature is dependent on the relative velocity between the polishing pad 230 and the wafer 220 and the coefficients of friction of the first film of the wafer 221 and the second film of the wafer 222 with respect to the polishing pad. The rise in the measured temperature of the polishing pad 230 is a function of the relative amount of the first film of the wafer 221 and the second film of the wafer 222, and so that the temperature varies non-linearly obviously.

As described above, the second film of the wafer 222 is made of dielectric material.

Furthermore, when the first film of the wafer 221 is fully removed, the rise in temperature of the polishing pad 230 is dependent on the relative velocity between the polishing pad 230 and the wafer 220 and the coefficient of friction of the second film of the wafer 222 with respect to the pad only. So that the rise in temperature of the polishing pad 230 varies linearly with time again. And the position correspondent with the turning point varying from non-linearly to linearly again is the endpoint of the CMP process.

Figure 4:
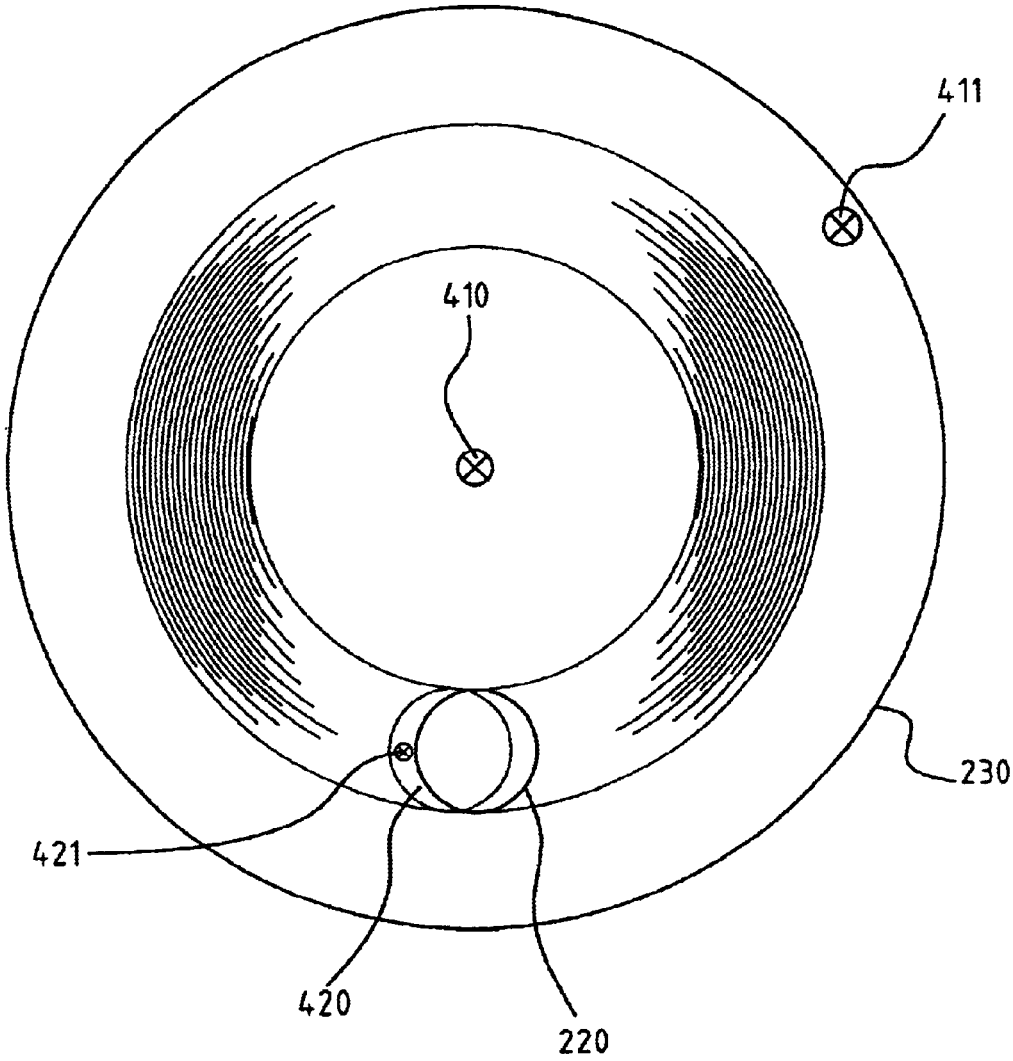
FIG. 4 shows a wafer-to-polished for use in the method according to the invention.

FIG. 4 shows a wafer-to-polished for use in the method according to the invention. With reference to FIG. 4, the method of the invention measures an environmental temperature by the thermal image camera 250 initially, and the position of the environmental temperature may be on the central portion of the polishing pad 410, the edge portion of the polishing pad 411, any portion of the non-frictional area of the polishing pad.

The wafer and the polishing pad rotate with respect to each other, and it causes the wafer to move from a first portion 421 of the polishing pad to a second portion. So the method of the invention measures one temperature of the first portion of the polishing pad by the thermal image camera 250. Moreover, a data processing for the measured temperature is done by PC, and the difference between the measured polishing pad and the environmental temperature is calculated to obtain the rise in temperature difference of the polishing pad for polishing, in order to get the variation of the polishing pad temperature.

The method of the invention repeats the above temperature measuring step. Then a curve is made according to the measured temperature, shows as FIG. 5, which includes a first constant value slope, a non-constant value slope, a second constant value slope, and the endpoint of the CMP process is determined by the turning point between the first constant value slope and the second constant value slope, shows as FIG. 6.

Figure 5:
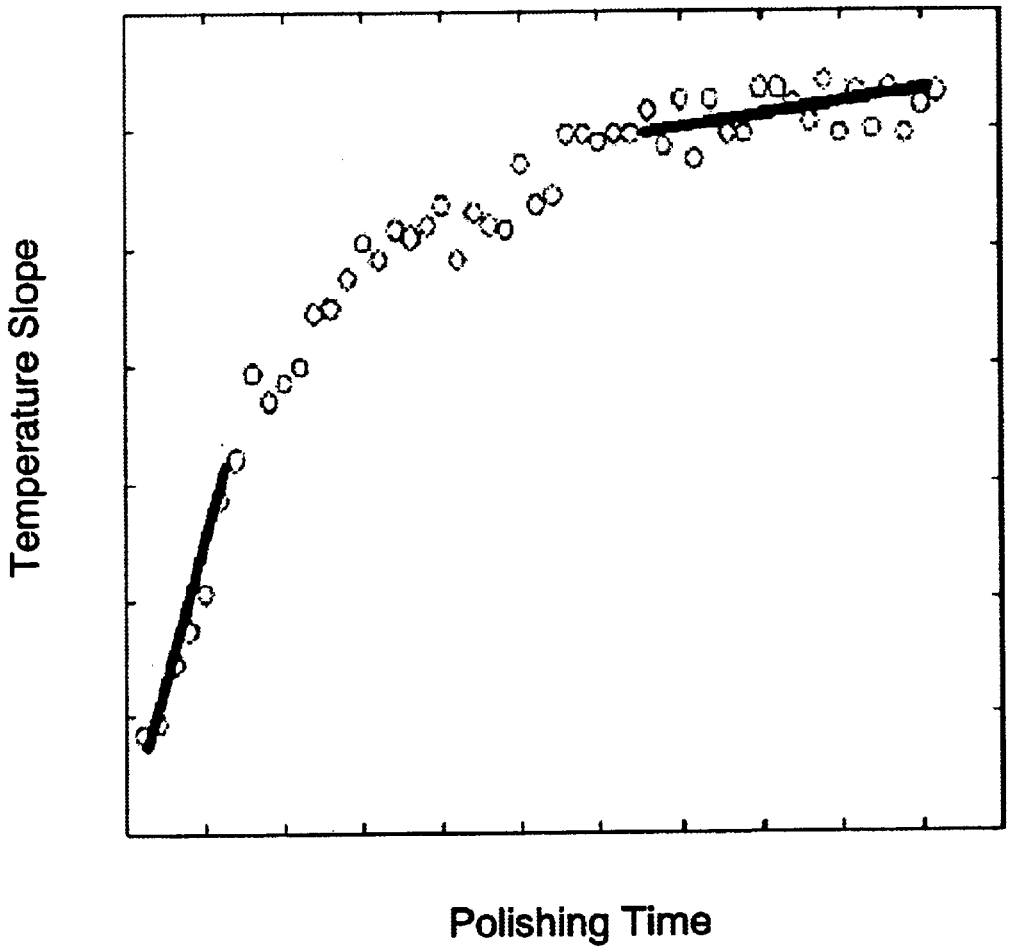
FIG. 5 shows the measured data of surface temperature of the polishing pad during polishing time.

FIG. 5 shows the measured data of the surface temperature of the polishing pad during polishing. With reference to FIG. 5, a dot represents a rise in the temperature of the first portion 421 of the polishing pad 421 for polishing verse time, and a line represents a curve, showing the rise in temperature of the area of the polishing pad 421 for friction verse time, calculated with the least square method by PC 260.

Figure 6:
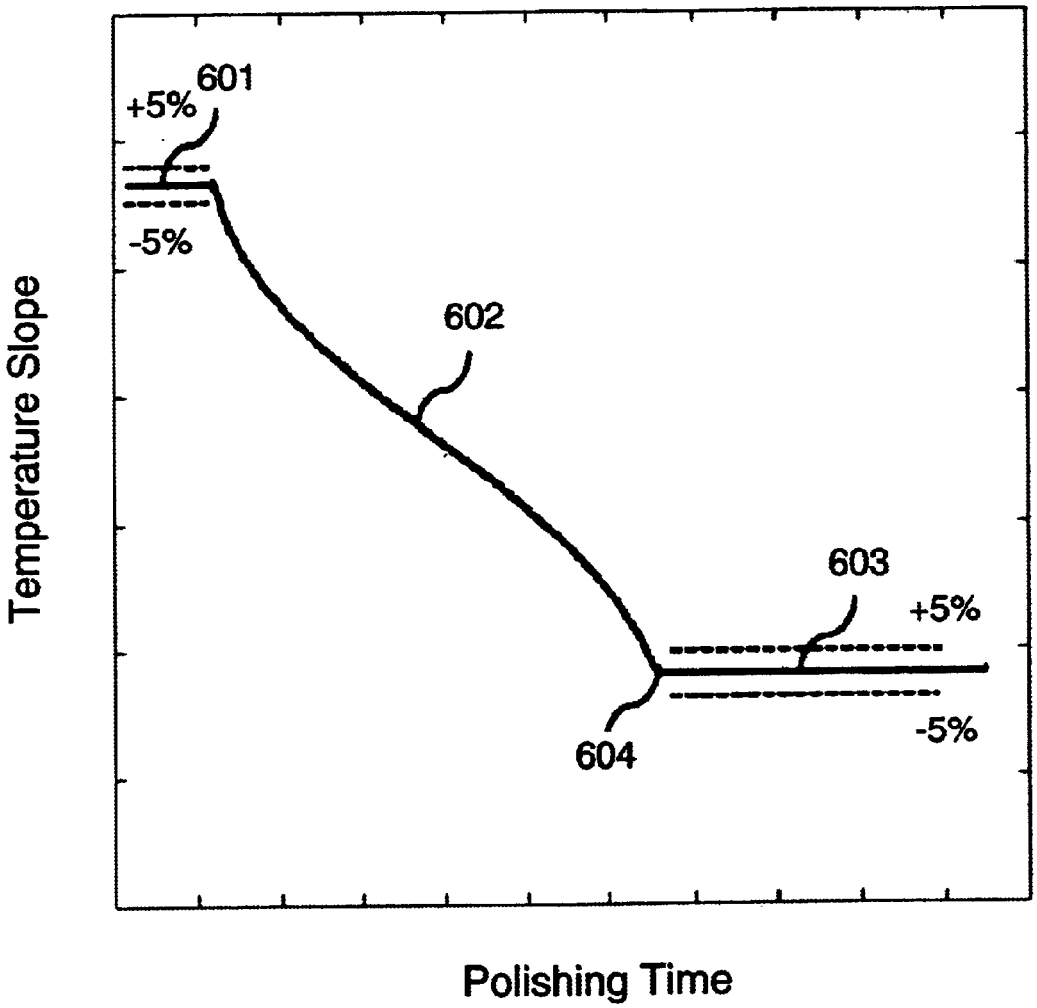
FIG. 6, according to the temperature curve of FIG. 5, shows the variety of temperature slope of the polishing pad versus polishing time.

FIG. 6, according to the temperature curve of FIG. 5, shows the variation of the temperature slope of the polishing pad versus polishing time. With reference to FIG. 6, the first constant-value segment of line 601 represents that the polishing pad polishes the first film of the wafer only. The segment of non-constant-value line 602 represents that the polishing pad polishes the first film of the wafer and the second film of the wafer at the same time. The second constant-value segment of line 603 represents that the polishing pad polishes the second film of the wafer only, and means the first film of the wafer is removed fully. Therefore, the turning point 604 represents the endpoint of the CMP process.

As described above, the slope of the first constant-value segment of line 601 and the second constant-value segment of line 603 may be in a predetermined variation.

As described above, the predetermined variation may be within five percent, shows as the dash line in FIG. 6.

Although the invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A method for detecting an endpoint of a chemical mechanical polishing (CMP) process comprising:

(a) setting up at least one carrier for fixing a wafer comprised of a plurality of material layers to a surface of a polishing pad;

(b) rotating the wafer and the polishing pad with respect to each other, and causing the wafer to move from a first portion of the polishing pad to a second portion;

(c) measuring one environmental temperature by a measuring device;

(d) measuring one temperature of the portion of the polishing pad by the measuring device;

(e) calculating a temperature difference between the temperature in step (c)–(d);

(f) repeating step (b)–(e), and making a curve which includes a first constant value slope, a non-constant value slope, a second constant value slope; and (g) determining an endpoint of the CMP process by a turning point between the first constant value slope and the second constant value slope.

2. The method of claim 1, wherein in said step (c)–(d) the measuring device is a single point temperature measuring device.

3. The method of claim 1, wherein in said step (c)–(d) the measuring device is a thermal image camera.

4. The method of claim 2, wherein said single point temperature measuring device is an infrared detection device.

5. The method of claim 1, wherein in said step (c) the environmental temperature at the central portion of the polishing pad.

6. The method of claim 1, wherein in said step (c) the environmental temperature at the edge portion of the polishing pad.

7. The method of claim 1, wherein in said step (c) the environmental temperature at any portion of the CMP apparatus in addition to the rotary polishing platen.

8. The method of claim 1, wherein in said step (c) the environmental temperature at any portion of the stable temperature in the environment.

9. The method of claim 1, wherein said step (c)–(g) use an operation device.

10. The method of claim 9, wherein said operation device is built-in the measuring device or linked.

11. The method of claim 9, wherein said operation device is linked to a computer.

12. The method of claim 1, wherein said step (f) uses a numerical method.

13. The method of claim 12, wherein said numerical method is the least square method or other linear regression methods.

14. The method of claim 12, wherein said numerical method is linear regression methods.

15. The method of claim 1, wherein in said step (f) the first constant value slope and the second constant value slope is in a predetermined variation.

16. The method of claim 15, wherein said predetermined variation is within five percent.

* * * * *